US005378347A

United States Patent [19]

Thomson et al.

[11] Patent Number: 5,378,347

[45] Date of Patent: Jan. 3, 1995

[54] REDUCING TIN SLUDGE IN ACID TIN PLATING

[75] Inventors: Donald Thomson, Northport, N.Y.; David A. Luke, Macclesfield, United Kingdom; Claudia Mosher, Amityville, N.Y.

[73] Assignee: LeaRonal, Inc., Freeport, N.Y.

[21] Appl. No.: 65,104

[22] Filed: May 19, 1993

[51] Int. Cl.[6] ..... C25D 3/32

[52] U.S. Cl. ..... 205/254; 205/300; 205/302; 106/1.12

[58] Field of Search ..... 205/254, 300, 302; 106/1.12

[56] References Cited

U.S. PATENT DOCUMENTS

| | | | |
|---|---|---|---|
| 4,111,760 | 9/1978 | Chen et al. | 204/26 |
| 4,388,158 | 6/1983 | Inui et al. | 205/302 |
| 4,871,429 | 10/1989 | Nobel et al. | 205/254 |
| 5,066,367 | 11/1991 | Nobel et al. | 204/44.4 |
| 5,094,726 | 3/1992 | Nobel et al. | 205/254 |
| 5,296,128 | 3/1994 | Gernon et al. | 205/254 |

OTHER PUBLICATIONS

G. R. Lakshminarayanan et al, "Electrodeposition Of Cobalt Using An Insoluble Anode," J. Electrochem. Soc., Nov. 1976,pp. 1612–1616.

C. P. Ho. *Matertials Protection,* vol. 24, No. 1, Jan. 1991, pp. 20–22.

*Primary Examiner*—John Niebling
*Assistant Examiner*—Kishor Mayekar
*Attorney, Agent, or Firm*—Pennie & Edmonds

[57] ABSTRACT

The present invention relates to a solution for use in the electroplating of tin and tin alloys comprising a basis solution which includes fluoboric acid or an organic sulfonic acid or one of their salts, divalent tin ions, and an antioxidant compound which includes a transition metal selected from the elements of Group IV B, V B or VI B of the Periodic Table in an amount effective to assist in maintaining the tin ions in the divalent state. Another aspect of the invention relates to a method for preventing, reducing or minimizing the oxidation of tin ions in an acid electroplating solution by adding one of these antioxidant compounds thereto. This method is effective in certain basis solutions even when iron contamination or high oxygen levels are present.

19 Claims, No Drawings

REDUCING TIN SLUDGE IN ACID TIN PLATING

TECHNICAL FIELD

The present invention relates to electroplating solutions and associated methods for reducing the amount of oxidation of stannous tin ions in an electroplating solutions containing same.

BACKGROUND ART

Electroplating baths containing divalent tin are used widely in industry for plating tin and/or tin alloys onto basis metals. These baths are acidic and are mainly based on acids such as sulfuric, phenolsulphonic, fluoboric, methane sulfonic, or a combination of hydrochloric and hydrofluoric. In all of these baths, a common problem has been the formation of a sludge during operation that results in a loss of divalent tin and excessive clean-up costs. This sludge occurs because, during the plating process, divalent tin has a tendency to become oxidized to tetravalent tin by oxidation at the anode or by oxygen which is introduced into the bath from the surrounding air. Tetravalent tin thus becomes soluble stannic acid which accumulates in the bath to eventually form $\beta$ stannic acid which is not soluble and which precipitates to form the undesirable sludge. In order to prevent the formation of this sludge, tin must remain in the divalent state.

When plating tin from these solutions onto strip steel using insoluble anodes, the problem is multiplied even further. Oxygen is liberated at these insoluble anodes to further oxidize divalent tin to its tetravalent state. U.S. Pat. No. 4,181,580 describes a process for plating strip steel using insoluble anodes and a method for replenishing tin. Divalent tin is replenished in these plating installations by separately dissolving metallic tin granules in a fluidized bed of acidic plating bath into which oxygen is fed to dissolve the metallic tin. The tin enriched solution is returned to the plating bath thereby replenishing the tin which has been plated out. Excess oxygen in the tin dissolving cell described in this patent can also react with divalent tin to form tetravalent tin; therefore, tin plating machines of this type are particularly subject to formation of tin sludge.

In normal plating installations using soluble anodes and cathode rod agitation, the sludge problem can be minimized. However, when rapid pumping of the solution is used in high speed plating machines, the inclusion of substantial amounts of air into the bath accelerates the oxidation of divalent tin by the oxygen which is present in the air. The sludge problem therefore exists somewhat in normal tin plating installations, is worsened in high speed plating installations, and is further worsened in strip steel machines that use insoluble anodes and tin dissolving cells.

Attempts have been made in the art to minimize sludge formation in these divalent tin baths. A paper by J. McCarthy entitled "Oxidation Characteristics of Tin-Plating Electrolytes," which appeared in the July 1960 issue of *Plating* magazine, discussed studies of tin oxidation by bubbling oxygen into various tin solutions. U.S. Pat. Nos. 5,094,726 and 5,066,367 disclose methods and solutions for limiting sludge using alkyl sulfonic acid based tin solutions in combination with reducing agents or antioxidants to prevent a buildup of $tin^{4+}$. Dihydroxybenzene reducing agents were disclosed to be very effective for this purpose. A recent paper by Chi Pong Ho of the Nanfang Metallurgical Institute appearing in Vol. 24#1 of *Materials Protection* (January 1991) describes the use of reducing agents based on vanadium pentoxide in divalent tin sulfate-sulfuric acid solutions to limit sludge formation.

Tin plating onto steel strip using acid solutions also results in a continual build-up of iron in the plating bath. The iron content can continue to build until its concentration reaches as high as about 30 g/l. Although the iron interferes only slightly in the tin deposition process, it causes a rapid acceleration of tin sludge formation and a decrease in rate of dissolution of metallic tin in the dissolving cell described above. Any antioxidant used to prevent tin sludge formation in strip plating installations should maintain its usefulness in the presence of this iron buildup in the bath.

SUMMARY OF THE INVENTION

The present invention relates to a solution for use in the electroplating of tin and tin alloys comprising a basis solution which includes fluoboric acid or an organic sulfonic acid or one of their salts, divalent tin ions, and an antioxidant compound which includes a transition metal selected from the elements of Group IV B, V B or VI B of the Periodic Table in an amount effective to assist in maintaining the tin ions in the divalent state.

The preferred transition metals of the antioxidant compound include vanadium, niobium, tantalum, titanium, zirconium or tungstens, and the preferred amount of antioxidant compound ranges from about 0.025 to 5 g/l. Generally, the antioxidant compound is added to the solution as an oxide or a solution soluble compound.

These antioxidant compounds are highly effective when used in a basis solution which comprises an alkane sulfonic acid, an alkanol sulfonic acid, an alkane sulfonate, an alkanol sulfonate, fluoboric acid, a fluoborate, phenol sulfonic acid or a phenol sulfonate. If desired, these solutions may also contain at least one or more of a wetting agent, a brightener, or divalent lead ions to improve or enhance electroplating performance or the resultant deposit characteristics.

The invention also relates to a method for preventing, reducing or minimizing the oxidation of tin ions in an acid electroplating solution which comprises adding an antioxidant compound which includes a transition metal selected from the elements of Group IV B, V B or VI B of the Periodic Table to an acid electroplating solutions which contains divalent tin ions. The antioxidant compound is added in an amount effective to assist in maintaining the tin ions in the divalent state. Also, this compound may be added to an electroplating solution which contains iron ion contamination.

DETAILED DESCRIPTION OF THE INVENTION

It has been found that the addition of certain multivalent metal compounds into divalent tin or tin alloy alkyl or alkylol sulfonic acid plating baths results in a substantially reduced rate of tin sludge formation. This is particularly true in high speed plating installations that pump the solution rapidly to provide a high agitation rate thereby introducing air into the plating bath. The improvement caused by the above combination is very significant, particularly in those installations that use insoluble anodes and a tin metal dissolving cell. The multivalent compounds that are effective are those based on the elements of groups IV B, V B, and VI B in the Periodic Table of the Elements.

The preferred metal compounds are those that are readily soluble in the plating bath, are relatively inexpensive, and readily available in commercial quantities. Typical of the preferred compounds are those of vanadium whose valences are 5+, 4+, 3+, and 2+. Any vanadium compound can be used provided it can form the required ions in solution and is not harmful to the bath. Examples of useful vanadium compounds are vanadium pentoxide ($V_2O_5$), vanadium sulfate $VOSO_4$, and sodium vanadate. If vanadium pentoxide ($V_2O_5$), previously dissolved in acid, is added to a tin plating bath, the existing $V^{5+}$ reacts with $tin^{2+}$ and becomes reduced to $V^{4+}$, $V^{3+}$, and $V^{2+}$, primarily by reacting with $tin^{2+}$ and metallic tin anodes. The dominant ions in solution are believed to be $V^{4+}$, $V^{3+}$ and $V^{2+}$. If $tin^{2+}$ becomes oxidized to $tin^{4+}$, it quickly reverts back to $tin^{2+}$ by reacting with $V^{2+}$ and $V^{3+}$ which then becomes $V^{4+}$. $V^{4+}$ then reacts with tin anodes to regenerate $V^{2+}$ and $V^{3+}$.

The other components of the electroplating baths are generally known to one of ordinary skill in the art.

The tin compounds useable are those which are soluble in the basis solution. The desired alloying metals can be added in any form which is soluble in or compatible with the basis solution. When sulfonic acids are used, the metals are preferably added in the form of sulfonate or sulfonic acid salts.

The acids which can be used in the invention are mentioned above and illustrated in the following examples. Alkane sulfonic acids containing 1–7 carbon atoms, alkylol sulfonic acids containing 1–7 carbon atoms, aromatic sulfonic acids, such as phenol sulfonic acid, or fluoboric acids, alone or in combination, are suitable for use as the basis solution. Methane sulfonic acid, "Ferrostan" (i.e., phenol sulfonic acid) and fluoboric acid are the most preferred. Salts or other derivatives of these acids can also be used, provided that the solution is sufficiently acidic and can retain all necessary components in solution. The pH range of these solutions will generally be less than 5, preferably 2–3 or less.

Any of a wide variety of surfactants can be included in the electroplating solutions of the invention. Since much of the electrodeposited tin is accomplished using high speed electroplating processes and equipment, it is preferred to utilize wetting agents or surfactants which are substantially non-foaming. Typical surfactants of this type can be fouled in U.S. Pat. Nos. 4,880,507 and 4,994,155, the disclosures of which are expressly incorporated herein by reference thereto.

When high speed electroplating is not necessary, any of the wetting agents or surfactants of U.S. Pat. No. 4,701,244 can be used. Of those surfactants, the higher cloud point materials are preferred. In addition, the solutions of the invention can contain brighteners, leveling agents or any other additives (such as bismuth compounds or acetaldehyde) which are known to those persons skilled in the art to improve the performance of the electroplating process or the properties of the resulting electrodeposit. The '244 patent is expressly incorporated herein for its disclosure of such surfactants and other additives.

The amounts of these surfactants or other additives are not critical and optimum amounts will vary depending on the particular agent selected for use and the particular bath in which it is used. Generally, about 0.05 to 10 ml/1 of the wetting agents give excellent results with pure tin and 60/40 tin-lead alloy baths. Higher amounts could be used but there is no particular reason to do so. As the lead content of the bath is increased, additional amounts of these wetting agents may have to be employed.

The electroplating solution can be prepared by placing tin compounds in an excess of the selected acid, adjusting the acid content to the required pH, adding the appropriate wetting agent and antioxidant compound, removing undissolved matter by filtration, and then diluting with water to the final desired volume. The electroplating solution is generally operated at ambient temperatures, although agitation and elevated temperatures are desirable for high speed electroplating. When the electroplating step is conducted under high speed conditions, the agitation and solution turnover due to pumping action maintains the oxygen content of the solution at or near its maximum concentration, thus promoting the tendency of to oxidize $tin^{2+}$ to $tin^{4+}$. Under these conditions, the use of the present antioxidants is most important to maintain tin as $tin^{2+}$.

Various alloys can be produced depending on the relative tin and alloying metal ratios employed in the solutions. For plating a 60-40 tin-lead alloy, for example, 20 g/l of tin metal and 10 g/l of lead metal can be used. Other ratios can be routinely determined by one of ordinary skill in the art.

EXAMPLES

The scope of the invention is further described in connection with the following examples which are set forth for the purposes of illustration only and are not to be construed as limiting the scope of the invention in any manner.

In order to determine whether a material is capable of reducing sludge in a given tin solution, a laboratory setup of the tin dissolving cell utilizing oxygen with a fluidized bed of tin granules described in U.S. Pat. No. 4,181,580 was constructed. The solution containing the antioxidant is pumped at a rapid rate through a bed of metallic tin granules and oxygen is fed into the solution. The rate of pumping was adjusted to a level capable of keeping the bed fluid with no settling of the metallic tin granules. The result is very rapid mixing of the oxygenated solution with the tin. This method of test is similar to that used by J. McCarthy described above except that a vastly increased oxygen flow is used with very thorough mixing of the oxygenated solution.

The tin solutions used in the above apparatus were the following:

| | Acid | $Tin^{2+}$ g/l | Free acid g/l | |
|---|---|---|---|---|
| 1) | Sulfuric | 30 | 15 | (Sulfate) |
| 2) | Phenolsulfonic | 30 | 15 | (Ferrostan) |
| 3) | Methylsulfonic | 30 | 15 | (MSA) |

All tests were made at ambient temperature, with a constant oxygen flow of 10 cu. ft./hr. at 50 psi, and the same level of pumping to produce the same fluidized bed. The same amount and size of tin granules was used to begin each test, the same volume of solution was used each time in the same apparatus, and the time for each test was 16 hours.

EXAMPLES 1–16

A number of electrolytes containing various antioxidants were prepared and tested as noted above. The sulfate baths, those baths which did not contain an antioxidant, and those baths which contained conventional antioxidants (i.e., examples 1–3 and 8–16) were included for comparison purposes. The test results appear in Table 1.

TABLE 1

| Example - Bath | Antioxidant (g/l) | Dissolved Iron (g/l) | Tin IV rate of buildup (g/hr) |
|---|---|---|---|
| 1-sulfate | none | 0 | 54.6 |
| 2-sulfate | $V_2O_5$ - 0.5 g/l | 0 | 30.5 |
| 3 - MSA | none | 0 | 5.83 |
| 4 - MSA | $V_2O_5$ - 0.5 g/l | 0 | 0 |
| 5 - MSA | $V_2O_5$ - 0.5 g/l | 5 | 0 |
| 6 - MSA | $V_2O_5$ - 0.5 g/l | 10 | 0.36 |
| 7 - MSA | $V_2O_5$ - 0.5 g/l | 20 | 7.83 |
| 8 - MSA | Catechol - 1 g/l | 0 | 0 |
| 9 - MSA | Catechol - 1 g/l | 5 | 1.35 |
| 10 - MSA | Catechol - 1 g/l | 10 | 2.80 |
| 11 - MSA | Catechol - 1 g/l | 20 | 9.90 |
| 12-Ferrostan | None | 0 | 0 |
| 13-Ferrostan | None | 3 | 1.35 |
| 14-Ferrostan | None | 5.7 | 2.89 |
| 15-Ferrostan | None | 13 | 2.91 |
| 16-Ferrostan | None | 20 | 28.7 |

The sulfate bath used by the Nanfang Metallurgical Institute described earlier, developed $tin^{4+}$ at a disastrous rate in this test and an unusually high amount of sludge was formed. When 0.5 g/l of $V_2O_5$ was added to this bath, there was an improvement; however, the amount of sludge and amount of $tin^{4+}$ generated was still completely unacceptable. Iron was not added to the bath in this test since it would only have made matters worse, as indicated by all other tests containing iron. Although the use of $V_2O_5$ in the Nanfang sulfate bath showed improvement in their tests, its use in strongly oxygenated solutions was of little value. Note the extremely high rate of $tin^{4+}$ build-up in the sulfate bath test results even with the addition of $V_2O_5$. The results indicate that the sulfate bath would be impractical for use in high-speed tin plating, even if $V_2O_5$ is added.

The combination of $V_2O_5$ with MSA (examples 4–7) showed a remarkable improvement. This combination was capable of reducing the amount of $tin^{2+}$ buildup to essentially zero. When iron was added to the bath, this build-up remained very close to zero even with an iron content of 10 g/l. The bath containing a very high iron content of 20 g/l showed an increase $tin^{4+}$ build-up which shows the harmful effect of iron in the bath, even with vanadium present.

The prior art tin baths containing MSA plus a catechol antioxidant (examples 8–11) behaved similarly to the MSA bath with vanadium, but was much worse than the MSA-vanadium bath when iron was added. These improved results with vanadium compared with catechol in the iron-containing MSA baths proved the unexpected superiority of vanadium as an antioxidant in the MSA bath.

The Ferrostan bath containing stannous sulfate and phenolsulfonic acid does not normally contain an additional antioxidant since phenolsulfonic acid is itself known to be a reducing agent or antioxidant. These baths behaved similarly to the MSA plus catechol bath when iron was added in increasing amounts up to 10 g/l. When 20 g/l iron was present in the tests of both the MSA and Ferrostan baths, the build-up of $tin^{4+}$ in the Ferrostan bath became excessive by comparison to the MSA. The Ferrostan Oath thus remains commercially feasible only when iron is periodically removed from production baths to minimize its harmful effects relating to sludge formation.

EXAMPLES 17–31

Additional tests were performed using the method of McCarthy. In these tests, the same amount of oxygen was bubbled into each flask under test containing tin granules plus the solution being tested. The major difference between the two test methods is the amount of oxygen bubbling into the test solutions and the time of test. The McCarthy test was run for 7 days at ambient temperature and oxygen flowed at 0.2 cu ft/hr.

To indicate that the inventive antioxidants are also beneficial in other divalent tin acid solutions, tests were also performed using tin in acidic fluoborate solutions and in the "Halogen" tin bath based on hydrofluoric and hydrochloric acids, both used in present day production for high speed plating. Without an antioxidant, both baths exhibited the same sludge problems exhibited by MSA and Ferrostan solutions. Tantalum, titanium, tungsten, zirconium, chromium, and molybdenum were also used as additional examples of multivalent ions which perform similar to vanadium and which demonstrate antioxidant qualities when iron was present in the plating solution.

The Halogen bath contained the following components:

| | |
|---|---|
| Stannous chloride | 75 g/l |
| Sodium fluoride | 30 g/l |
| Sodium bifluoride | 45 g/l |
| Sodium chloride | 50 g/l |
| pH | 3.2–3.6 |

The fluoborate bath contained the following components:

| | |
|---|---|
| Tin fluoborate | 200 g/l |
| Fluoboric acid (free) | 150 g/l |
| Boric acid | 30 g/l |

Each bath was formulated with an antioxidant in accordance with the present invention. Titanium was added as titanium chloride, tantalum was added as tantalum chloride, vanadium as vanadium sulfate, tungsten as sodium tungstate, zirconium as zirconium sulfate, chromium as chromium sulfate, and molybdenum as molybdenum chloride. The amount of metal used as an antioxidant in each solution was 0.28 g/l.

The Ferrostan bath was the same as that in the previous test.

Ten g/l of dissolved iron was added to some test solutions and 20 g/l of dissolved iron to others in order to simulate production baths containing iron. The bubbling oxygen test results are shown in Table 2.

Results show that vanadium, tantalum, titanium, zirconium, and tungsten are effective as antioxidants to reduce $tin^{4+}$ buildup in the presence of oxygen. Chromium and molybdenum are far less effective. The baths in which the antioxidants are effective are organic sulfonic acid based baths such as methyl sulfonic acid and phenolsulfonic acid, and in fluoboric acid based baths. Results with the Halogen bath were poor, showing that the antioxidants are not effective in these baths when they contain iron. The Halogen paths are successful in production since iron, which accelerates $tin^{4+}$ buildup, is constantly being removed from solution and is not permitted to build up to any appreciable amount.

The useful quantities of these multivalent metal antioxidants can vary from about 0.025 g/l of metal in solution to about 5 g/l. Their effectiveness is apparent in very low concentrations with increasing effectiveness with increasing concentration until about 1 g/l. Above 1 g/l, there is only slight improvement. Generally, the multivalent metals either do not co-deposit at all with the metal being plated or they may only be detected in the deposit in trace amounts.

TABLE 2

| Example - Bath | Antioxidant (one g/l) | Dissolved Iron (g/l) | % Divalent Sn lost to form Sn IV |
|---|---|---|---|
| 17 - MSA | none | 10 | 20.9 |
| 18 - MSA | vanadium | 10 | 16.4 |
| 19 - MSA | tantalum | 10 | 15.9 |
| 20 - MSA | titanium | 10 | 13.4 |
| 21-Ferrostan | none | 10 | 28.2 |
| 22-Ferrostan | vanadium | 10 | 15.5 |
| 23-Fluoborate | none | 10 | 12.4 |
| 24-Fluoborate | vanadium | 10 | 3.6 |
| 25-Halogen | none | 10 | 95 |
| 26-Halogen | vanadium | 10 | 95 |
| 27 - MSA | zirconium | 20 | 31.8 |
| 28 - MSA | vanadium | 20 | 30.7 |
| 29 - MSA | tungsten | 20 | 40.4 |
| 30 - MSA | molybdenum | 20 | 95 |
| 31 - MSA | chromium | 20 | 68 |

What is claimed is:

1. A solution for use in the electroplating of tin and tin alloys comprising: a basis solution which includes one of fluoboric acid, an organic sulfonic acid or one of their salts; divalent tin ions; and an antioxidant compound which includes a transition metal selected from the elements of Group IV B, V B or VI B of the Periodic Table in an amount effective to assist in maintaining the tin ions in the divalent state but less than 5 g/l.

2. The solution of claim 1 wherein the transition metal of the antioxidant compound is vanadium, niobium, tantalum, titanium, zirconium or tungsten.

3. The solution of claim 2 wherein the antioxidant compound is an oxide or a solution soluble compound.

4. The solution of claim 1 wherein the basis solution comprises an alkane sulfonic acid or alkane sulfonate.

5. The solution of claim 1 wherein the basis solution comprises fluoboric acid or fluoborate.

6. The solution of claim 1 wherein the basis solution comprises phenol sulfonic acid or a phenol sulfonate.

7. The solution of claim 1 further comprising at least one of a wetting agent, a brightener, or divalent lead ions.

8. The solution of claim 7 wherein the wetting agent is one which is substantially non-foaming.

9. The solution of claim 1 which further includes iron ion contamination.

10. A solution for use in the electroplating of tin and tin alloys comprising: a basis solution which includes one of fluoboric acid, an alkane sulfonic acid, an alkanol sulfonic acid or an aromatic sulfonic acid or one of their salts; divalent tin ions; and an antioxidant compound of vanadium, niobium, tantalum, titanium, zirconium or tungsten in an amount effective to assist in maintaining the tin ions in the divalent state.

11. A method for preventing, reducing or minimizing the oxidation of tin ions in an acid electroplating solution which comprises adding an antioxidant compound which includes a transition metal selected from the elements of Group IV B, V B or VI B of the Periodic Table to an acid electroplating solution which contains one of fluoboric acid, an organic acid or one of their salts and divalent tin ions, said antioxidant compound being added in an amount effective to assist in maintaining the tin ions in the divalent state but less than 5 g/l.

12. The method of claim 11 which further comprises selecting the transition metal of the antioxidant compound to be vanadium, niobium, tantalum, titanium, zirconium or tungsten.

13. The method of claim 12 which further comprises selecting the antioxidant compound to be in the form of an oxide or a solution soluble compound.

14. The method of claim 11 which further comprises selecting the acid electroplating solution to be one of an alkane sulfonic acid, an alkanol sulfonic acid, an alkane sulfonate, an alkanol sulfonate, fluoboric acid, a fluoborate, phenol sulfonic acid or a phenol sulfonate.

15. The method of claim 11 wherein the electroplating solution contains iron ion contamination.

16. The method of claim 11 which further comprises including at least one of a wetting agent, a brightener, or divalent lead ions into the solution.

17. The method of claim 16 which further comprises selecting the wetting agent to be one which is substantially non-foaming.

18. The method of claim 11 which further comprises conducting an electroplating step under conditions which result in oxygen content in the solution at or near its maximum concentration.

19. The composition of claim 10 wherein the antioxidant compound is present in an amount of between about 0.025 and 5 g/l.

* * * * *